US008418469B2

(12) United States Patent
Myers et al.

(10) Patent No.: US 8,418,469 B2
(45) Date of Patent: Apr. 16, 2013

(54) FUEL NOZZLE ASSEMBLY FOR GAS TURBINE SYSTEM

(75) Inventors: Geoffrey David Myers, Simpsonville, SC (US); Nishant Govindbhai Parsania, Bangalore (IN); Gregory Allen Boardman, Greer, SC (US)

(73) Assignee: General Electric Company, Schenectady, NY (US)

( * ) Notice: Subject to any disclaimer, the term of this patent is extended or adjusted under 35 U.S.C. 154(b) by 231 days.

(21) Appl. No.: 12/890,903

(22) Filed: Sep. 27, 2010

(65) Prior Publication Data

US 2012/0073302 A1 Mar. 29, 2012

(51) Int. Cl.
*F02C 1/00* (2006.01)

(52) U.S. Cl.
USPC ..... 60/748; 60/737

(58) Field of Classification Search ..... 60/737, 60/740, 742, 747–748
See application file for complete search history.

(56) References Cited

U.S. PATENT DOCUMENTS

| | | | | |
|---|---|---|---|---|
| 5,085,575 | A | 2/1992 | Keller et al. | |
| 5,295,352 | A | 3/1994 | Beebe et al. | |
| 5,351,477 | A | 10/1994 | Joshi et al. | |
| 5,408,825 | A | 4/1995 | Foss et al. | |
| 5,511,375 | A | 4/1996 | Joshi et al. | |
| 5,675,971 | A * | 10/1997 | Angel et al. | 60/746 |
| 5,778,676 | A * | 7/1998 | Joshi et al. | 60/746 |
| 6,438,961 | B2 | 8/2002 | Tuthill et al. | |
| 6,705,087 | B1 * | 3/2004 | Ohri et al. | 60/748 |
| 7,140,560 | B2 | 11/2006 | Stotts et al. | |
| 7,316,117 | B2 * | 1/2008 | Ohri | 60/796 |
| 7,370,466 | B2 * | 5/2008 | Cai | 60/39.11 |
| 8,117,845 | B2 * | 2/2012 | Lacy et al. | 60/737 |
| 8,122,721 | B2 * | 2/2012 | Johnson et al. | 60/742 |
| 8,186,162 | B2 * | 5/2012 | Rogers et al. | 60/737 |
| 2005/0268614 | A1 * | 12/2005 | Widener | 60/772 |
| 2006/0236700 | A1 | 10/2006 | Saitoh et al. | |
| 2007/0074518 | A1 * | 4/2007 | Rogers et al. | 60/776 |
| 2007/0277530 | A1 * | 12/2007 | Dinu et al. | 60/772 |
| 2010/0132364 | A1 * | 6/2010 | Myers et al. | 60/748 |
| 2011/0005189 | A1 * | 1/2011 | Uhm et al. | 60/39.281 |
| 2012/0023951 | A1 * | 2/2012 | Parsania et al. | 60/748 |

OTHER PUBLICATIONS

United States Patent Application—U.S. Appl. No. 12/845,986, filed Jul. 29, 2010.

* cited by examiner

*Primary Examiner* — Phutthiwat Wongwian
(74) *Attorney, Agent, or Firm* — Dority & Manning, P.A.

(57) ABSTRACT

A fuel nozzle assembly is disclosed. The fuel nozzle assembly comprises an outer burner tube and an inner burner tube defining a pre-mixing annulus therebetween. The fuel nozzle assembly further comprises a swirler assembly, the swirler assembly comprising a plurality of swirler vanes disposed in an annular array about the inner burner tube and configured to interact with primary air upstream of the pre-mixing annulus. The fuel nozzle assembly further comprises an air injection feature configured to flow secondary air into the pre-mixing annulus downstream of the swirler assembly such that the secondary air flows in a generally linear path longitudinally with respect to the pre-mixing annulus and adjacent at least one of the outer burner tube and the inner burner tube.

18 Claims, 4 Drawing Sheets

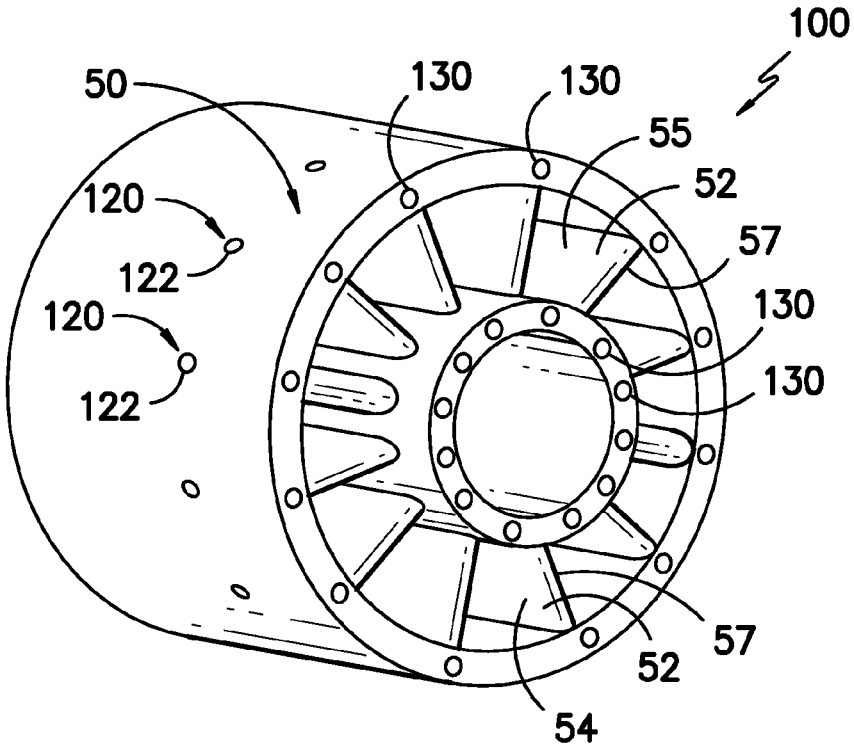
FIG. —4—
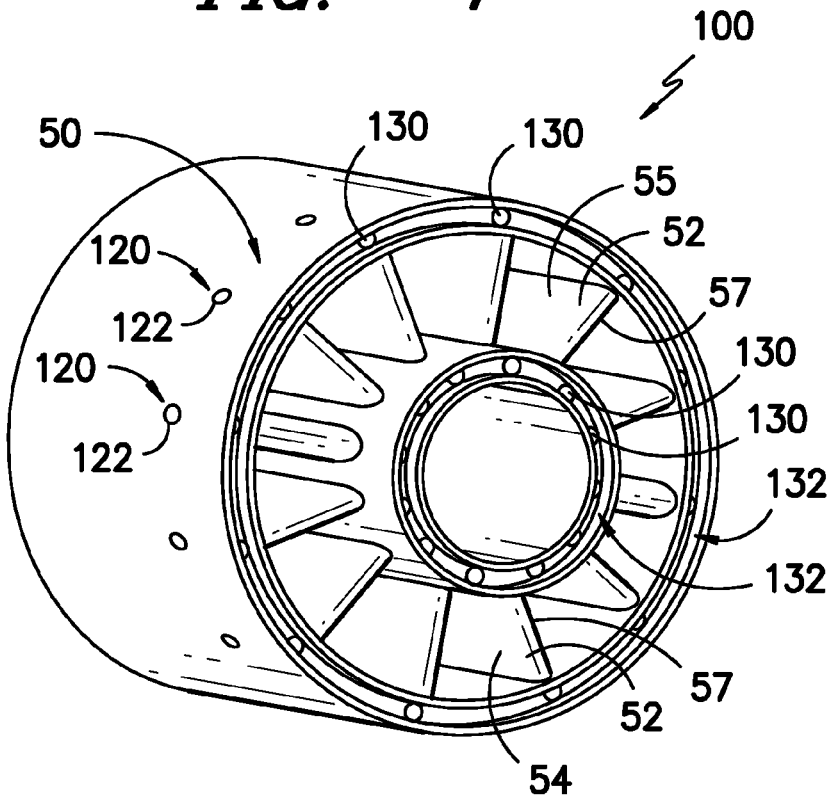
FIG. —5—

FUEL NOZZLE ASSEMBLY FOR GAS TURBINE SYSTEM

FIELD OF THE INVENTION

The present disclosure relates generally to gas turbine systems, and more particularly to fuel nozzle assemblies in gas turbine systems.

BACKGROUND OF THE INVENTION

Gas turbine systems are widely utilized in fields such as power generation. A conventional gas turbine system includes a compressor, a combustor, and a turbine. In a conventional gas turbine system, compressed air is provided from the compressor to the combustor. The air entering the combustor is mixed with fuel and combusted. Hot gases of combustion flow from the combustor to the turbine to drive the gas turbine system and generate power.

Natural gas is typically utilized as a primary fuel for a gas turbine system. The natural gas is mixed with air in a fuel nozzle assembly in or adjacent to the combustor to provide a lean, pre-mixed air/fuel mixture for combustion. Gas turbine systems typically also require a secondary fuel that allows the system to continue to run when the primary fuel is not available. The secondary fuel is typically a liquid fuel, such as oil.

Typical prior art devices and apparatus for providing secondary fuel in a fuel nozzle assembly supply the secondary fuel as a fuel stream sprayed directly into or adjacent to a flame zone. This fuel stream is a relatively rich fuel mixture, as opposed to the relatively lean pre-mixed air/fuel mixture obtained when using the primary fuel. Consequently, the temperature of the combusted secondary fuel mixture and the resulting rate of NO formation are typically undesirably high. To lower the temperature and $NO_x$ level, water, steam, or other inert fluids are typically supplied and mixed with the secondary fuel as the fuel is sprayed into the flame zone. However, this system is relatively inefficient, and expensive. For example, an independent system must be utilized to supply the water or other fluid.

One solution for reducing the inefficiencies and expenses of the above prior art solutions is to inject a portion of the secondary fuel into an airflow upstream of the ignition source, thus premixing the secondary fuel. However, this solution may have a variety of disadvantages. For example, the premixed air/secondary fuel mixture may be relatively rich, and may encourage flashback and flame-holding within the fuel nozzle. Further, some of the secondary fuel injected into the airflow may accumulate on various surfaces inside the fuel nozzle assembly, and may cause coking on these surfaces. Coking is the oxidative pyrolysis or destructive distillation of fuel molecules into smaller organic compounds, and further into solid carbon particles, at high temperatures. Coking thus causes the deposition of solid carbon particles onto various surfaces of the fuel nozzle assembly, leading to the disruption of flow in the fuel nozzle assembly and further impairing the low emissions operation of the primary fuel.

Thus, an apparatus that provides for better pre-mixing of a secondary fuel in a fuel nozzle assembly would be desired in the art. Additionally, an apparatus for pre-mixing a secondary fuel in a fuel nozzle assembly that reduces the associated expenses and increases the associated efficiency would be advantageous. Further, an apparatus for pre-mixing a secondary fuel in a fuel nozzle assembly that prevents or reduces flashback, flame-holding, and coking in the fuel nozzle assembly would be desired.

BRIEF DESCRIPTION OF THE INVENTION

Aspects and advantages of the invention will be set forth in part in the following description, or may be obvious from the description, or may be learned through practice of the invention.

In one embodiment, a fuel nozzle assembly is disclosed. The fuel nozzle assembly comprises an outer burner tube and an inner burner tube defining a pre-mixing annulus therebetween. The fuel nozzle assembly further comprises a swirler assembly, the swirler assembly comprising a plurality of swirler vanes disposed in an annular array about the inner burner tube and configured to interact with primary air upstream of the pre-mixing annulus. The fuel nozzle assembly further comprises an air injection feature configured to flow secondary air into the pre-mixing annulus downstream of the swirler assembly such that the secondary air flows in a generally linear path longitudinally with respect to the pre-mixing annulus and adjacent at least one of the outer burner tube and the inner burner tube.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which:

FIG. 4 is a perspective view of one embodiment of an air injection feature of the present disclosure as shown in FIG. 3; and FIG. 5 is a perspective view of another embodiment of an air injection feature of the present disclosure;

DETAILED DESCRIPTION OF THE INVENTION

Figure 1:
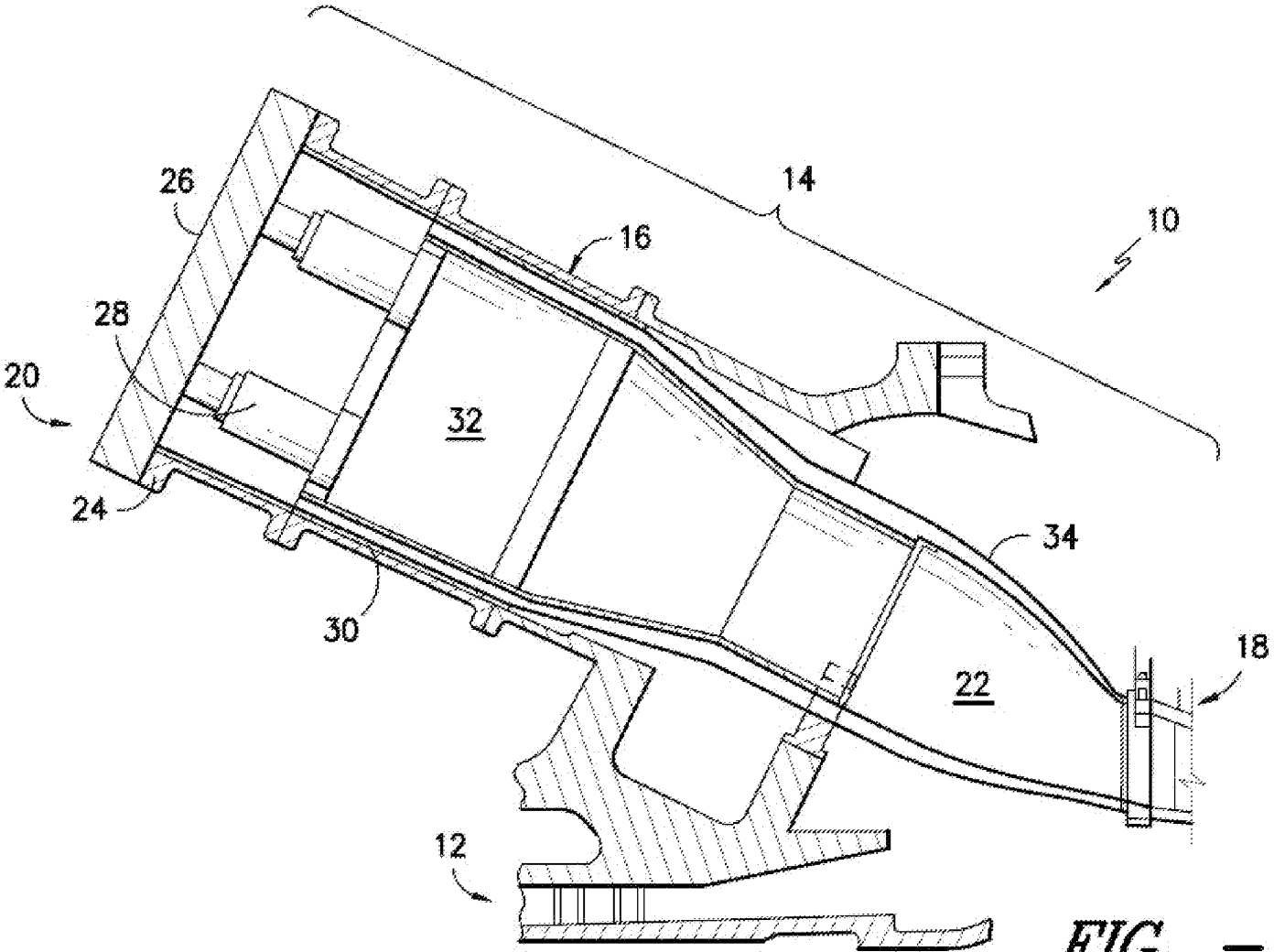
FIG. 1 is a cross-sectional view of several portions of a gas turbine system of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Referring to FIG. 1, a simplified drawing of several portions of a gas turbine system 10 is illustrated. The system 10 comprises a compressor section 12 for pressurizing a gas, such as air, flowing into the system 10. It should be understood that while the gas may be referred to herein as air, the gas may be any gas suitable for use in a gas turbine system 10.

Pressurized air discharged from the compressor section 12 flows into a combustor section 14, which is generally characterized by a plurality of combustors 16 (only one of which is illustrated in FIG. 1) disposed in an annular array about an axis of the system 10. The air entering the combustor section 14 is mixed with fuel and combusted. Hot gases of combustion flow from each combustor 16 to a turbine section 18 to drive the system 10 and generate power.

Each combustor 16 in the gas turbine 10 may include a combustion system 20 for mixing and combusting an air/fuel mixture, and a transition piece 22 for flowing hot gases of combustion to the turbine section 18. The combustion system 20 of each combustor 16 may include a combustion casing 24, an end cover 26, and a plurality of fuel nozzle assemblies 28. It should also be appreciated that each combustor 16 and combustion system 20 may include any number of fuel nozzle assemblies 28. Fuel may be supplied to each fuel nozzle assembly 28 by one or more manifolds (not shown).

During operation, pressurized air exiting the compressor section 12 flows into each combustor 16 through a flow sleeve 30 of a combustion chamber 32 and an impingent sleeve 34 of the transition piece 22, where it is swirled and mixed with fuel injected into each fuel nozzle assembly 28. The air/fuel mixture exiting each fuel nozzle assembly 28 flows into the combustion chamber 32, where it is combusted. The hot gases of combustion then flow through transition piece 22 to the turbine section 18 in order to drive the system 10 and generate power. It should be readily appreciated, however, that a combustor 16 need not be configured as described above and illustrated herein and may generally have any configuration that permits pressurized air to be mixed with fuel, combusted and transferred to a turbine section 18 of the system 10. For example, the present disclosure encompasses annular combustors and silo-type combustors as well as any other suitable combustors.

Referring to FIGS. 2 through 5, various embodiments of a fuel nozzle assembly 28 of the present disclosure are illustrated. Primary air 42 to be combusted may flow through an outer annulus of the fuel nozzle assembly 28, as discussed herein. As shown, the fuel nozzle assembly 28 may include an inlet flow conditioner 44 to improve the air flow velocity distribution of the primary air 42. The fuel nozzle assembly 28 may also include plurality of concentric tubes defining discrete annular passages 46 and 48. Passage 46 may supply a flow of air, while passage 48 may supply a primary fuel (not shown), such as natural gas, through the fuel nozzle assembly 28. The primary fuel may further be supplied to the combustion chamber 36 of the combustor 16 (FIG. 1) through a swirler assembly 50 comprising a plurality of swirler vanes 52. The swirler vanes 52 may further be configured to interact with the primary air 42. For example, each of the swirler vanes 52 may include a pressure side 54 (see FIGS. 4 and 5) and a suction side 55 extending between a leading edge 56 and a trailing edge 57. Primary air 42 flowing from the inlet flow conditioner 44 may be directed through the swirler vanes 52 to impart a swirling pattern to the primary air 42 and to facilitate the mixing of the primary air 42 with the primary fuel. The swirler vanes 52 may include fuel injection ports or holes 58 that inject primary fuel flowing from the passage 48 into the primary air 42. The primary air 42 and primary fuel may then flow into a pre-mixing annulus 60. The pre-mixing annulus 60 may be generally downstream of the swirler assembly 50, and may be defined by an outer burner tube 62 and an inner burner tube 64. The primary air 42 and primary fuel may be mixed in the pre-mixing annulus 60 prior to entering the combustion chamber 36. As shown, the inner burner tube 64 may include the passages 46 and 48 therein, and the swirler vanes 52 may be disposed in an annular array about the inner burner tube 64 and between the inner burner tube 64 and outer burner tube 62. However, it should be readily appreciated that the fuel nozzle assembly 28 as described above may be configured or arranged in any manner generally known to those of ordinary skill and need not be configured as described.

In exemplary embodiments, when the primary fuel is not available for use with the system 10 and fuel nozzle assemblies 28 of the present disclosure or when otherwise desired, a secondary fuel 70 may be flowed through the fuel nozzle assemblies 28, mixed with primary air 42, and combusted. The secondary fuel 70 may, in exemplary embodiments, be a liquid fuel, such as diesel fuel, oil or an oil mixture. However, it should be understood that the secondary fuel of the present disclosure may be any suitable liquid fuel for use in a fuel nozzle assembly 28.

A cartridge 80 may be provided in the fuel nozzle assembly 28 for flowing the secondary fuel 70 therethrough. The cartridge 80 may extend through at least a portion of the fuel nozzle assembly 28, and may be configured to flow the secondary fuel 70 therethrough. For example, the cartridge 80 may be a tube, pipe, conduit, or other suitable apparatus. The cartridge 80 may accept secondary fuel 70 from one or more secondary fuel manifolds (not shown), and the secondary fuel 70 may flow through the cartridge 80, as discussed herein. The cartridge 80 may generally be disposed within the inner burner tube 64. For example, the cartridge 80 may extend through the passage 46. The cartridge 80 may have any suitable cross-sectional shape or size. For example, in some embodiments, the cartridge 80 may have a generally circular or oval cross-section. Further, the cartridge 80 need not be linear or of uniform cross-section along its length; for example, the cartridge 80 could curve and/or taper.

The cartridge 80 of the present disclosure may define a passage or a plurality of passages. The passages may be configured to flow the secondary fuel 70 or another fluid therethrough. In exemplary embodiments, the plurality of passages may be concentrically aligned passages. However, it should be understood that any suitable alignment of the passages is within the scope and spirit of the present disclosure.

For example, the cartridge 80 may define a pre-mix passage 82. The pre-mix passage 82 may be in fluid communication with the pre-mixing annulus 60, as discussed below. At least a portion of the secondary fuel 70 flowing through the cartridge 80 may flow through the pre-mix passage 82 for injection into the pre-mixing annulus 60.

The cartridge 80 may further define a diffusion passage 84. The diffusion passage 84 may be configured to bypass any fluid communication with the pre-mixing annulus 60. For example, a portion of the secondary fuel 70 flowing through the cartridge 80 may flow through the diffusion passage 84. This portion of the secondary fuel 70 may be supplied to a tip 86 of the fuel nozzle assembly 28. A pilot flame (not shown) disposed adjacent the tip 86 may ignite the secondary fuel 70 exiting the diffusion passage 84 and the tip 86. Secondary fuel 70 supplied through the diffusion passage 84 may be utilized as a backup system to the secondary fuel 70 supplied through pre-mix passage 82 for pre-mixing, or may be utilized in conjunction with the pre-mix passage 82 or otherwise as desired.

As mentioned above, the pre-mix passage 82 may be in fluid communication with the pre-mixing annulus 60. To provide this fluid communication, at least one, or a plurality of, radially extending injection bores 90 may be defined in the inner burner tube 64. The injection bores 90 may be configured to accept at least a portion of the secondary fuel 70 from the cartridge 80, and may flow the secondary fuel 70 into the pre-mixing annulus 60. For example, the secondary fuel 70 may flow through the cartridge 102, such as through the pre-mix passage 82. At least one, or a plurality of, radially extending injection tubes 92 may be provided between the pre-mix passage 82 and the injection bores 90, and may be in fluid communication with the pre-mix passage 82 and the injection bore 90. The secondary fuel 70 flowing through the cartridge 80, such as through the pre-mix passage 82, may be flowed through the injection tubes 92 into the injection bores 90, and further into the pre-mixing annulus 60. It should be understood that the injection tubes 92 may exhaust the secondary fuel 70 into the injection bores 90, or the injection tubes 92 may extend through the injection bores 90 and exhaust the secondary fuel 70 directly into the pre-mixing annulus 60, or the pre-mix passage 82 may be in direct fluid communication with the injection bores 90. Thus, the pre-mix passage 82 may be in fluid communication with the injection bores 90, while the diffusion passage 84 may bypass the injection bores 90.

The cartridge 80 may thus allow pre-mixing of at least a portion of the secondary fuel 70 with primary air 42 in the pre-mixing annulus 60 of the fuel nozzle assembly 28. However, a portion of the secondary fuel 70 provided for pre-mixing in the pre-mixing annulus 60 may, rather than mixing with the primary air 42, become disposed on the inner surface of the outer burner tube 62 and/or the outer surface of the inner burner tube 64. This accumulated secondary fuel 70 may cause coking on the outer and inner burner tubes 62, 64, and/or may increase the likelihood of flashback and flame-holding.

Thus, the fuel nozzle assembly 28 may include an air injection feature 100. The air injection feature 100 may be configured to flow secondary air 102 into the pre-mixing annulus 60 downstream of the swirler assembly 50. The secondary air 102 may flow within the pre-mixing annulus 60 in a generally linear path longitudinally with respect to the pre-mixing annulus 60, and may flow adjacent at least one of the outer burner tube 62 and the inner burner tube 64. By flowing in a generally linear path longitudinally with respect to the pre-mixing annulus 60 and adjacent to the outer burner tube 62 and/or the inner burner tube 64, the secondary air 102 may interact with secondary fuel 70 disposed on the outer burner tube 62 and/or the inner burner tube 64. For example, secondary air 102 flowing generally adjacent the inner surface of the outer burner tube 62 may interact with secondary fuel 70 disposed and accumulating on the inner surface of the outer burner tube 62. Secondary air 102 flowing generally adjacent the outer surface of the inner burner tube 64 may interact with secondary fuel 70 disposed and accumulating on the outer surface of the inner burner tube 64. By interacting with the accumulated secondary fuel 70, the secondary air 102 may sweep away and/or evaporate this accumulated secondary fuel 70. This may improve mixing of the secondary fuel 70 with the secondary air 102 and the primary air 42, and/or may provide a leaner air/fuel mixture. Further, the sweeping away of accumulated secondary fuel 70 may reduce or eliminate the likelihood of flashback and flame-holding, and/or may reduce or eliminate coking on the outer and inner burner tubes 62, 64.

It should be understood that the present disclosure is directed to a secondary flow 102 that flows in a generally linear path longitudinally with respect to the pre-mixing annulus 60. Thus, interaction of the secondary flow 102 with the primary flow 42 in the pre-mix annulus may generally be discouraged. Rather, the secondary flow 102 of the present disclosure is intended to flow linearly adjacent the inner and/or outer burner tubes 62, 64, beneficially interacting with accumulated secondary fuel 70 on the outer and/or inner burner tubes 62, 64.

It should be understood that the air injection feature 100 of the present disclosure may flow secondary air 102 into the pre-mixing annulus 60 such that the secondary air 102 flows generally adjacent only the outer burner tube 62 (such as the inner surface thereof), only the inner burner tube 64 (such as the outer surface thereof), or both the outer and inner burner tubes 62, 64. It should further be understood that the secondary air 102 may be supplied to the air injection feature 100 from any suitable air supply. For example, the secondary air 102 may be a portion of the primary air 42 that is diverted to the air injection feature 100. Alternatively, the secondary air 102 may be supplied to the air injection feature 100 independently of the primary air 42. For example, the secondary air 102 may be compressor discharge air, or may be air supplied to the air injection feature 100 from any other suitable independent source.

Figure 2:
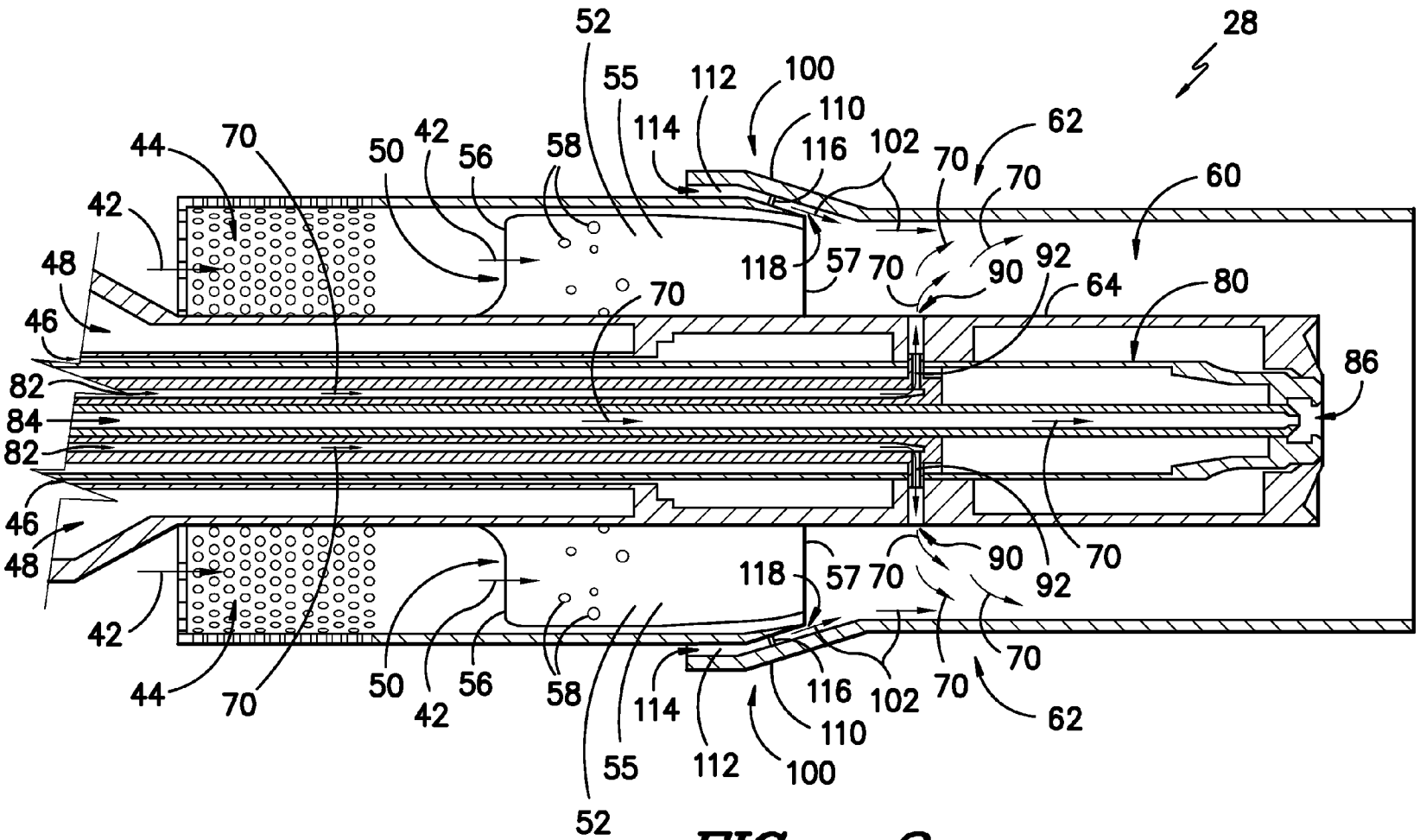
FIG. 2 is a cross-sectional view of one embodiment of a fuel nozzle assembly of the present disclosure.

The air injection feature 100 of the present disclosure may, according to an exemplary embodiment as shown in FIG. 2, comprise a sleeve or sleeves 110. The sleeve 110 may be associated with the outer burner tube 62 and/or the inner burner tube 64. For example, in some embodiments, a section of the outer burner tube 62 and/or the inner burner tube 64 may be removed, and may be replaced with a sleeve 110. Alternatively, the sleeve 110 may simply be a modified portion of the outer burner tube 62 and/or inner burner tube 64. The sleeve 110 may define a plurality of bore holes 112. The bore holes 112 may be defined about the sleeve 110, such as in an annular array about the sleeve 110. The bore holes 112 may be configured to accept secondary air 102, such as through inlets 114. Further, the bore holes 112 may be configured to exhaust the secondary air 102 adjacent the outer burner tube 62 (such as the inner surface thereof) and/or the inner burner tube 64 (such as the outer surface thereof). For example, as shown in FIG. 2, the bore holes 112 may accept secondary air 102 through an inlet or inlets 114 from a source external to the outer burner tube 62, and the secondary air 102 may flow through the bore holes 112 and be exhausted adjacent the outer burner tube 62. This secondary air 102 may then flow through the pre-mixing annulus 60 generally adjacent the outer burner tube 62. Alternatively or additionally, in embodiments wherein the sleeve 110 is configured to exhaust secondary air 102 adjacent the inner burner tube 64, the bore holes 112 may accept secondary air 102 through an inlet or inlets 114 from, for example, radially extending feed passages, as discussed below.

The bore holes 112 may have any suitable cross-sectional shape or area, and may further be of any suitable length. Further, the bore holes 112 may, for example, be tapered. The bore holes 112 may be generally longitudinally extending bore holes 112. Further, the bore holes 112 may generally not have any circumferentially extending components. The generally longitudinally extending bore holes 112 may thus encourage the secondary air 102 flowing through the bore holes 112 to flow into and through the pre-mixing annulus 60 in linear, longitudinal directions adjacent the outer burner tube 62 and/or the inner burner tube 64, and may further discourage mixing of the secondary air 102 with the primary air 42. However, the bore holes 112 may further extend radially inward or outward at any suitable delivery angle as they extend longitudinally, to supply the secondary air 102 adjacent the outer burner tube 62 and/or inner burner tube 64.

As mentioned above, the bore holes 112 may be configured to exhaust the secondary air 102 adjacent the outer burner tube 62 and/or inner burner tube 64. In some exemplary embodiments, the secondary air 102 may be exhausted directly from outlets 116 of the bore holes 112 into the pre-mix annulus 60 adjacent the outer burner tube 62 and/or inner burner tube 64. In other exemplary embodiments, the sleeve 110 may further define an annulus 118 or annuluses 118. The annulus 118 may be defined downstream of the outlets 116, such that the bore holes 112 exhaust the secondary air 102 through the outlets 116 into the annulus 118. The secondary air 102 may then be allowed to mix in the annulus 118 before being exhausted into the pre-mix annulus 60 adjacent the outer burner tube 62 and/or inner burner tube 64.

Figure 3:
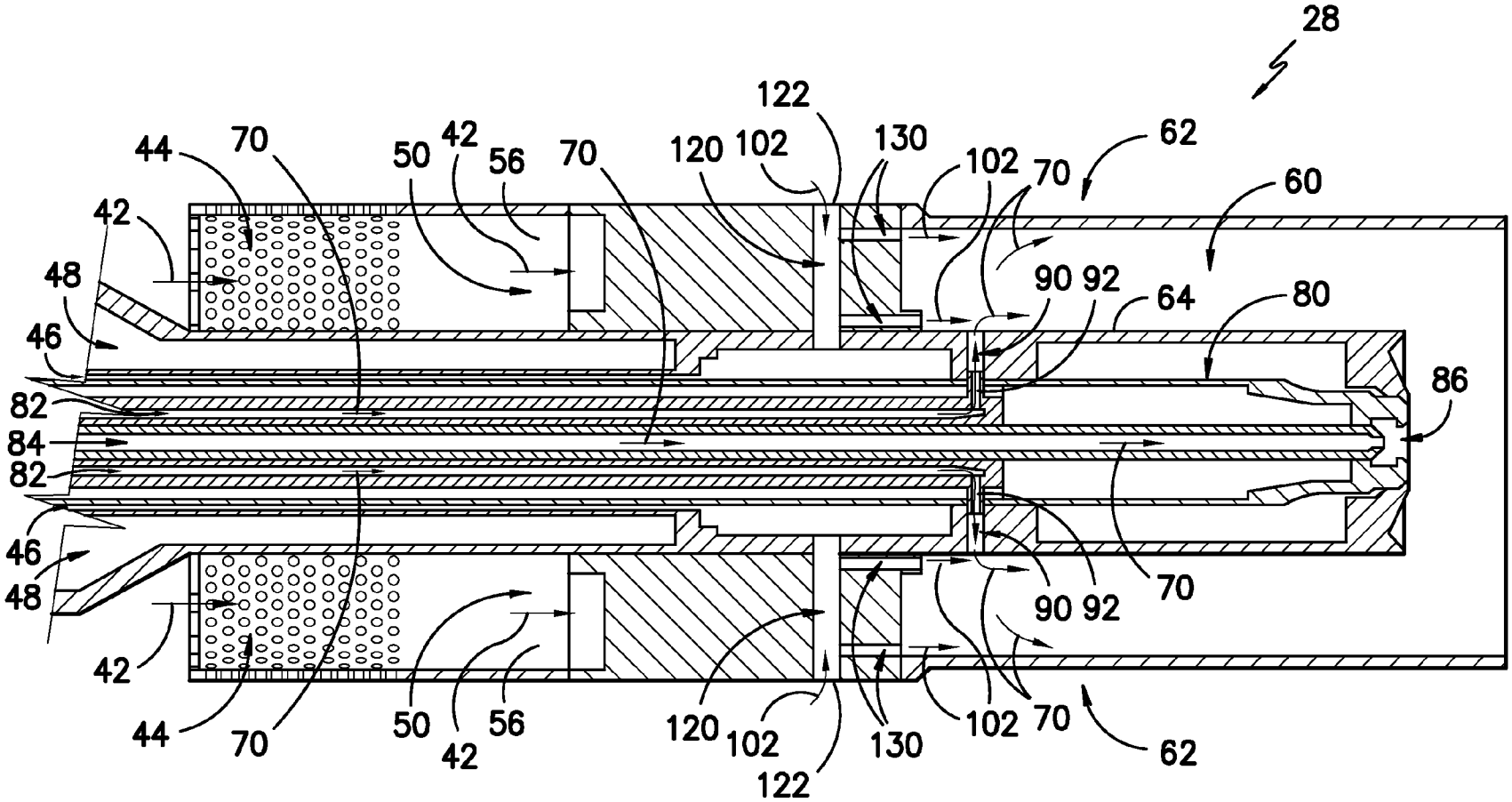
FIG. 3 is a cross-sectional view of another embodiment of a fuel nozzle assembly of the present disclosure.

In some exemplary embodiments, such as the embodiment shown in FIGS. 3 through 5, the air injection feature 100, or various portions thereof, may be defined in the swirler assembly 50. For example, the air injection feature 100 may comprise a feed passage 120 or a plurality of feed passages 120. The feed passages 120 may be radially extending feed passages 120, and may be configured to flow secondary air 102 therethrough. For example, each of the feed passages 120 may be defined in one of the plurality of swirler vanes 52. The feed passages 120 may further extend through the swirler assembly 50 and the outer burner tube 62 to the exterior of the fuel nozzle assembly 28, such that secondary air 102 may flow into and be accepted by inlets 122 of the feed passages 120.

In some embodiments, as shown in FIGS. 3 through 5, the air injection feature 100 may further comprise a bore hole 130 or a plurality of bore holes 130. The bore holes 130 may be defined in the swirler assembly 50, and each of the bore holes 130 may be in fluid communication with one of the feed passages 120. The bore holes 130 may be configured to flow the secondary air 102 from the feed passages 120 into the pre-mixing annulus 60. For example, secondary air 102 flowed into the feed passages 120 may flow from the feed passages 120 into the bore holes 130, and the bore holes 130 may flow the secondary air 102 therethrough, exhausting the secondary air 102 into the pre-mixing annulus 60 generally adjacent the outer burner tube 62 and/or the inner burner tube 64.

The bore holes 130 may exhaust the secondary air 102 generally adjacent the outer burner tube 62 (such as the inner surface thereof) and/or the inner burner tube 64 (such as the outer surface thereof). As shown in FIGS. 3 through 5, for example, various of the bore holes 130 may be defined in the swirler assembly 50 adjacent the outer burner tube 62, such that the secondary air 102 exhausted therefrom flows generally adjacent the outer burner tube 62. Additionally or alternatively, various of the bore holes 130 may be defined in the swirler assembly 50 adjacent the inner burner tube 64, such that the secondary air 102 exhausted therefrom flows generally adjacent the inner burner tube 64.

The bore holes 130 may have any suitable cross-sectional shape or area, and may further be of any suitable length. Further, the bore holes 130 may, for example, be tapered. The bore holes 130 may generally be longitudinally extending bore holes 130. Further, the bore holes 130 may generally not have any circumferentially extending components. The generally longitudinally extending bore holes 130 may thus encourage the secondary air 102 flowing through the bore holes 130 to flow into and through the pre-mixing annulus 60 in linear, longitudinal directions adjacent the outer burner tube 62 and/or the inner burner tube 64, and may further discourage mixing of the secondary air 102 with the primary air 42. However, the bore holes 130 may further extend radially inward or outward at any suitable delivery angle as they extend longitudinally, to supply the secondary air 102 adjacent the outer burner tube 62 and/or inner burner tube 64.

As shown in FIG. 5, the air injection feature 100 may further comprise an annulus 132 or annuluses 132. The annulus 132 may be defined in the swirler assembly 50, and may be in fluid communication with the feed passages 120. For example, the annulus 132 may be in direct fluid communication with the feed passages 120, such that the secondary air 102 flows directly from the feed passages 120 into the annulus 132. Alternatively, as shown in FIG. 5, the annulus 132 may be defined downstream of and in fluid communication with the bore holes 130, such that secondary air 102 flows from the feed passages 120 through the bore holes 130 into the annulus 132. The annulus 132 may be configured to flow the secondary air 102 from the feed passages 120 into the pre-mixing annulus 60. For example, secondary air 102 flowed into the annulus 132 may flow from the feed passages 120 into the annulus 132, and the annulus 132 may flow the secondary air 102 therethrough, exhausting the secondary air 102 into the pre-mixing annulus 60 generally adjacent the outer burner tube 62 and/or the inner burner tube 64.

The annulus 132 or annuluses 132 may exhaust the secondary air 102 generally adjacent the outer burner tube 62 (such as the inner surface thereof) and/or the inner burner tube 64 (such as the outer surface thereof). As shown in FIG. 5, for example, an annulus 132 may be defined in the swirler assembly 50 adjacent the outer burner tube 62, such that the secondary air 102 exhausted therefrom flows generally adjacent the outer burner tube 62. Additionally or alternatively, an annulus 132 may be defined in the swirler assembly 50 adjacent the inner burner tube 64, such that the secondary air 102 exhausted therefrom flows generally adjacent the inner burner tube 64.

As discussed above, the air injection feature 100 may be configured to flow secondary air 102 into the pre-mixing annulus 60 generally adjacent the outer burner tube 62 and/or the inner burner tube 64. In some exemplary embodiments, the secondary air 102 flowing into the pre-mixing annulus 60 may form a film adjacent the outer burner tube 62 and/or the inner burner tube 64. For example, in embodiments discussed above wherein the secondary air 102 enters the pre-mixing annulus 60 from an annulus, the secondary air 102 exhausted from the annulus may form a film of air. The film may flow through the pre-mixing annulus adjacent the outer burner tube 62 (such as the inner surface thereof) and/or the inner burner tube 64 (such as the outer surface thereof).

In other exemplary embodiments, the secondary air 102 flowing into the pre-mixing annulus 60 may form a plurality of air jets adjacent the outer burner tube 62 and/or the inner burner tube 64. For example, in embodiments discussed above wherein the secondary air 102 enters the pre-mixing annulus 60 from the outlets of a plurality of bore holes, the secondary air 102 exhausted from each of the outlets may form an air jet. The air jets may flow through the pre-mixing annulus adjacent the outer burner tube 62 (such as the inner surface thereof) and/or the inner burner tube 64 (such as the outer surface thereof).

It should be understood, however, that the embodiments wherein a film is formed are not limited to embodiments wherein the secondary air 102 flows from an annulus, and the embodiments wherein a plurality of air jets are formed is not limited to embodiments wherein the secondary air 102 flows from a plurality of bore hole outlets. Rather, any configuration of the air injection feature 100 such that the secondary air 102 forms a film or films, any configuration of the air injection feature 100 such that the secondary air 102 forms a plurality of air jets, and any configuration wherein the secondary air 102 is flowed along a generally linear path longitudinally with respect to the pre-mixing annulus 60, are within the scope and spirit of the present disclosure.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A fuel nozzle assembly, the fuel nozzle assembly comprising:

an outer burner tube and an inner burner tube defining a pre-mixing annulus therebetween;

a swirler assembly, the swirler assembly comprising a plurality of swirler vanes disposed in an annular array about the inner burner tube and configured to interact with primary air upstream of the pre-mixing annulus;

an air injection feature having at least one inlet outward of the swirler assembly and at least one outlet downstream of the swirler assembly to flow secondary air into the pre-mixing annulus downstream of the swirler assembly such that the secondary air flows in a generally linear path longitudinally with respect to the pre-mixing annulus and adjacent at least one of the outer burner tube and the inner burner tube; and a sleeve associated with the one of the outer burner tube and the inner burner tube, the sleeve defining a plurality of bore holes configured to exhaust the secondary air adjacent the one of the outer burner tube and the inner burner tube.

2. The fuel nozzle assembly of claim 1, wherein the air injection feature is configured to flow the secondary air into the pre-mixing annulus such that the secondary air forms a film adjacent the at least one of the outer burner tube and the inner burner tube.

3. The fuel nozzle assembly of claim 1, wherein the air injection feature is configured to flow the secondary air into the pre-mixing annulus such that the secondary air forms a plurality of air jets adjacent the at least one of the outer burner tube and the inner burner tube.

4. The fuel nozzle assembly of claim 1, wherein the air injection feature is configured to flow the secondary air into the pre-mixing annulus such that the secondary air flows generally adjacent both the outer burner tube and the inner burner tube.

5. The fuel nozzle assembly of claim 1, wherein the secondary air is supplied to the air injection feature independently of the primary air.

6. A fuel nozzle assembly, the fuel nozzle assembly comprising:

an outer burner tube and an inner burner tube defining a pre-mixing annulus therebetween;

a swirler assembly, the swirler assembly comprising a plurality of swirler vanes disposed in an annular array about the inner burner tube and configured to interact with primary air upstream of the pre-mixing annulus;

an air injection feature having at least one inlet outward of the swirler assembly and at least one outlet downstream of the swirler assembly to flow secondary air into the pre-mixing annulus downstream of the swirler assembly such that the secondary air flows in a generally linear path longitudinally with respect to the pre-mixing annulus and adjacent at least one of the outer burner tube and the inner burner tube; and a plurality of radially extending feed passages, each of the feed passages defined in one of the plurality of swirler vanes.

7. The fuel nozzle assembly of claim 6, the air injection feature comprising an annulus, the annulus defined in the swirler assembly and in fluid communication with the plurality of feed passages, the annulus configured to flow the secondary air from the plurality of feed passages into the pre-mixing annulus.

8. The fuel nozzle assembly of claim 6, the air injection feature comprising a plurality of bore holes defined in the swirler assembly and in fluid communication with the plurality of feed passages, the plurality of bore holes configured to flow the secondary air from the plurality of feed passages into the pre-mixing annulus.

9. A fuel nozzle assembly, the fuel nozzle assembly comprising:

an outer burner tube and an inner burner tube defining a pre-mixing annulus therebetween;

a swirler assembly, the swirler assembly comprising a plurality of swirler vanes disposed in an annular array about the inner burner tube and configured to interact with primary air upstream of the pre-mixing annulus;

an air injection feature having at least one inlet outward of the swirler assembly and at least one outlet downstream of the swirler assembly to flow secondary air into the pre-mixing annulus downstream of the swirler assembly such that the secondary air flows in a generally linear path longitudinally with respect to the pre-mixing annulus and adjacent at least one of the outer burner tube and the inner burner tube;

a cartridge extending through at least a portion of the inner burner tube and configured to flow a secondary fuel therethrough; and at least one radially extending injection bore defined in the inner burner tube and in fluid communication with the cartridge, the at least one injection bore configured to flow at least a portion of the secondary fuel from the cartridge into the pre-mixing annulus, wherein the secondary air interacts with secondary fuel disposed on the at least one of the outer burner tube and the inner burner tube.

10. The fuel nozzle assembly of claim 9, the cartridge defining a pre-mix passage, the pre-mix passage in fluid communication with the at least one radially extending injection bore.

11. The fuel nozzle assembly of claim 9, the cartridge defining a diffusion passage configured to bypass the at least one radially extending injection bore.

12. A combustor for a gas turbine system, the combustor comprising:

at least one fuel nozzle assembly, the at least one fuel nozzle assembly comprising:

an outer burner tube and an inner burner tube defining a pre-mixing annulus therebetween;

a swirler assembly, the swirler assembly comprising a plurality of swirler vanes disposed in an annular array about the inner burner tube and configured to interact with primary air upstream of the pre-mixing annulus;

an air injection feature having at least one inlet outward of the swirler assembly and at least one outlet downstream of the swirler assembly to flow secondary air into the pre-mixing annulus downstream of the swirler assembly such that the secondary air flows in a generally linear path longitudinally with respect to the pre-mixing annulus and adjacent at least one of the outer burner tube and the inner burner tube; and a sleeve associated with the one of the outer burner tube and the inner burner tube, the sleeve defining a plurality of bore holes configured to exhaust the secondary air adjacent the one of the outer burner tube and the inner burner tube.

13. The combustor of claim 12, further comprising a plurality of fuel nozzle assemblies.

14. The combustor of claim 12, wherein the air injection feature is configured to flow the secondary air into the pre-mixing annulus such that the secondary air flows generally adjacent both the outer burner tube and the inner burner tube.

15. The combustor of claim 12, further comprising:

a cartridge extending through at least a portion of the inner burner tube and configured to flow a secondary fuel therethrough; and at least one radially extending injection bore defined in the inner burner tube and in fluid communication with the cartridge, the at least one injection bore configured to flow at least a portion of the secondary fuel from the cartridge into the pre-mixing annulus, wherein the secondary air interacts with secondary fuel disposed on the at least one of the outer burner tube and the inner burner tube.

16. A combustor for a gas turbine system, the combustor comprising:

at least one fuel nozzle assembly, the at least one fuel nozzle assembly comprising:

an outer burner tube and an inner burner tube defining a pre-mixing annulus therebetween;

a swirler assembly, the swirler assembly comprising a plurality of swirler vanes disposed in an annular array about the inner burner tube and configured to interact with primary air upstream of the pre-mixing annulus;

a plurality of radially extending feed passages, each of the feed passages defined in one of the plurality of swirler vanes; and an air injection feature having at least one inlet outward of the swirler assembly and at least one outlet downstream of the swirler assembly to flow secondary air into the pre-mixing annulus downstream of the swirler assembly such that the secondary air flows in a generally linear path longitudinally with respect to the pre-mixing annulus and adjacent at least one of the outer burner tube and the inner burner tube.

17. The combustor of claim 16, the air injection feature comprising an annulus, the annulus defined in the swirler assembly and in fluid communication with the plurality of feed passages, the annulus configured to flow the secondary air from the plurality of feed passages into the pre-mixing annulus.

18. The combustor of claim 16, the air injection feature comprising a plurality of plurality of bore holes defined in the swirler assembly and in fluid communication with the plurality of feed passages, the plurality of bore holes configured to flow the secondary air from the plurality of feed passages into the pre-mixing annulus.

* * * * *

UNITED STATES PATENT AND TRADEMARK OFFICE

CERTIFICATE OF CORRECTION

PATENT NO. : 8,418,469 B2
APPLICATION NO. : 12/890903
DATED : April 16, 2013
INVENTOR(S) : Myers et al.

It is certified that error appears in the above-identified patent and that said Letters Patent is hereby corrected as shown below:

In the Claims

Column 12, Claim 18, line 25
delete "plurality of"
should read comprising a plurality bore holes defined in the.

Signed and Sealed this
Thirteenth Day of May, 2014

Michelle K. Lee

Michelle K. Lee
*Deputy Director of the United States Patent and Trademark Office*